US006737950B2

(12) United States Patent
Onaya et al.

(10) Patent No.: US 6,737,950 B2
(45) Date of Patent: May 18, 2004

(54) WINDING STRUCTURE OF STARTER

(75) Inventors: Kazunari Onaya, Maebashi (JP); Syuuji Miyazawa, Ota (JP); Syuichi Aoki, Oura (JP); Yasuo Osawa, Nitta (JP); Youichi Hasegawa, Kasugai (JP)

(73) Assignees: Sawafuji Electric Co., Ltd, Tokyo (JP); Denso Corporation, Aichi (JP)

( * ) Notice: Subject to any disclaimer, the term of this patent is extended or adjusted under 35 U.S.C. 154(b) by 10 days.

(21) Appl. No.: 10/174,742

(22) Filed: Jun. 19, 2002

(65) Prior Publication Data

US 2003/0001708 A1 Jan. 2, 2003

(30) Foreign Application Priority Data

Jun. 28, 2001 (JP) ..... 2001/195744

(51) Int. Cl.[7] ..... H01F 27/30
(52) U.S. Cl. ..... 336/208; 336/198; 336/192
(58) Field of Search ..... 336/208, 198, 336/192

(56) References Cited

U.S. PATENT DOCUMENTS 4,347,493 A * 8/1982 Adams et al. ..... 336/192
4,449,111 A * 5/1984 Nakajima ..... 336/206
5,898,252 A * 4/1999 Tanaka et al. ..... 310/214

FOREIGN PATENT DOCUMENTS

JP 52-42321 9/1977

* cited by examiner

*Primary Examiner*—Anh Mai
(74) *Attorney, Agent, or Firm*—McGlew and Tuttle, P.C.

(57) ABSTRACT

According to the present invention, in a winding structure of a starter, in which a shunt coil 1 is wound around a bobbin 2 shaped like U in a cross section, the shunt coil 1 wound around the bobbin 2 is taped and fixed at a plurality of places together with the bobbin 2, and the shunt coil 1 is placed into a yoke of a starter in this state, the bobbin 2 has a notch 6 which is formed with a depth larger than a winding height of the shunt coil 1 on both of side winding frames of the bobbin 2 at a taping position.

6 Claims, 13 Drawing Sheets

WINDING STRUCTURE OF STARTER

CROSS-REFERENCE TO RELATED APPLICATIONS

This application claims priority from Japanese patent application Serial No. 2001-195744 filed Jun. 28, 2001, the contents of which are incorporated by reference herein.

BACKGROUND OF THE INVENTION

1. Field of the Invention

The present invention relates to a winding structure of a starter and particularly concerns a winding structure of a starter whereby when a shunt coil of the starter is wound around a bobbin by an automatic coil winder, a wire on a lead-out part of a winding start of the shunt coil (may be referred to as a winding end based on a direction of applying current) prevents a shape of a winding frame of the bobbin from being lost and firmly fixes the wound shunt coil into the bobbin.

2. Description of the Related Art

As a winding of a starter, a field coil and a shunt coil that generate a magnetic field have been provided in addition to an armature coil. Such a shunt coil acts as a load for accelerating the rotation and stopping of a starter when auxiliary torque is increased and at the return of a pinion with an overrunning clutch, as well as for generating initial torque of the starter.

Incidentally, as shown in FIG. 22 which is an assembly drawing of a shunt coil winding, FIG. 23 which is a sectional view taken along a line A—A of FIG. 22, and FIG. 24 which is a sectional view taken along a line B—B of FIG. 22, in a conventional bobbin 2 where a shunt coil 1 is wound and which is shaped like U(character U) in a cross section, when the shunt coil 1 is automatically wound, winding is performed while a shunt coil winding start 3 is fixed at the center of a winding frame on the top along the length of the bobbin 2 based on a position of a lead of the shunt coil winding start 3 (winding end when a direction of applying current is reversed), a shunt coil winding end 4 is drawn from the same part as the shunt coil winding start 3, and required parts are taped with an insulating tape 5 from the outside of the winding frame of the bobbin 2, so that the shunt coil 1 is fixed.

In the bobbin 2 where the conventional shunt coil 1 is shaped like U in a cross section of the winding frame, a wire on a lead-out part of the winding start 3 of the shunt coil wound around the bobbin 2 is drawn to the outside of the winding frame from the bottom of the winding frame of the bobbin 2 (FIG. 24). Thus, as shown in FIG. 24, the wire on the lead-out part of the shunt coil winding start 3 protrudes outward, and as the shunt coil 1 is wound around the bobbin 2, the winding frame on the side of the bobbin 2 is widened outward as indicated by an arrow of FIG. 24, so that the top end of the winding is widened.

When the shunt coil 1 wound around the bobbin 2 having the conventional shape is mounted in a yoke of a starter, due to the widened top end of the winding frame of the bobbin 2, there is a possibility that the bobbin 2 might be in contact with an armature without obtaining a gap from the armature, resulting in damage on the bobbin 2.

Further, since the winding frame of the bobbin 2 is taped with the insulating tape 5 from the outside of the winding frame to fix the shunt coil 1, the shunt coil 1 is not directly fixed. Thus, there is a possibility that the shunt coil 1 might vibrate in the bobbin 2 and cause a short circuit.

SUMMARY OF THE INVENTION

The present invention has been achieved in view of the above-described point and has as its object the provision of a winding structure of a starter whereby when a shunt coil is wound around a bobbin, a wire on the lead-out part of the winding start of the shunt coil is less likely to widen the top end of a winding frame of the bobbin, and the shunt coil is firmly fixed in the bobbin In order to attain the above-described object, the winding structure of the starter of the present invention, in which a shunt coil is wound around a bobbin shaped like U in a cross section, the shunt coil wound around the bobbin is taped and fixed at a plurality of places together with the bobbin, and the shunt coil is placed into a yoke of a starter in this state, is characterized in that the bobbin has a first notch formed with a depth larger than a winding height of the shunt coil on both of side winding frames of the bobbin at a taping position.

And then, the winding structure of the starter of the present invention is characterized in that in addition to the above-described notch, a second notch straight in shape is formed from the bottom of the winding frame on at least one of side winding frames at a position of the bobbin where winding of the shunt coil is started.

Further, the winding structure of the starter of the present invention, in which a shunt coil is wound around a bobbin shaped like U in a cross section, the shunt coil wound around the bobbin is taped and fixed at a plurality of places together with the bobbin, and the shunt coil is placed into a yoke of a starter in this state, is characterized in that the bobbin has a tapered second notch which is formed from the bottom of the winding frame on at least one of the side winding frames at a position of the bobbin where winding of the shunt coil is started.

Besides, the winding structure of the starter of the present invention, in which a shunt coil is wound around a bobbin shaped like U in a cross section, the shunt coil wound around the bobbin is taped and fixed at a plurality of places together with the bobbin, and the shunt coil is placed into a yoke of a starter in this state, is characterized in that the bobbin has a first notch which is formed with a depth larger than a winding height of the shunt coil on both of side winding frames of the bobbin at a taping position, and the bobbin has a tapered second notch formed on at least one of the side winding frames at a position of the bobbin where winding of the shunt coil is started.

Moreover, the first notch and/or the second notch may be formed from the bottom of the winding frame. Furthermore, the first notch and/or the second notch may be formed continuously with a third notch formed on the bottom of the winding frame of the bobbin.

Since the first notch having a depth larger than a winding height of the shunt coil is formed on both of side winding frames of the bobbin, the shunt coil can be firmly fixed into the bobbin by taping on the first notch. Further, since the second notch or the first notch and the second notch allow the drawing part of the winding start of the shunt coil to escape to the outside from the inside of the bobbin, that is, the inside of the winding frame of the bobbin, the top end of the winding frame of the bobbin is less likely to be widened.

DETAILED DESCRIPTION OF THE PREFERRED EMBODIMENTS

Figure 1:
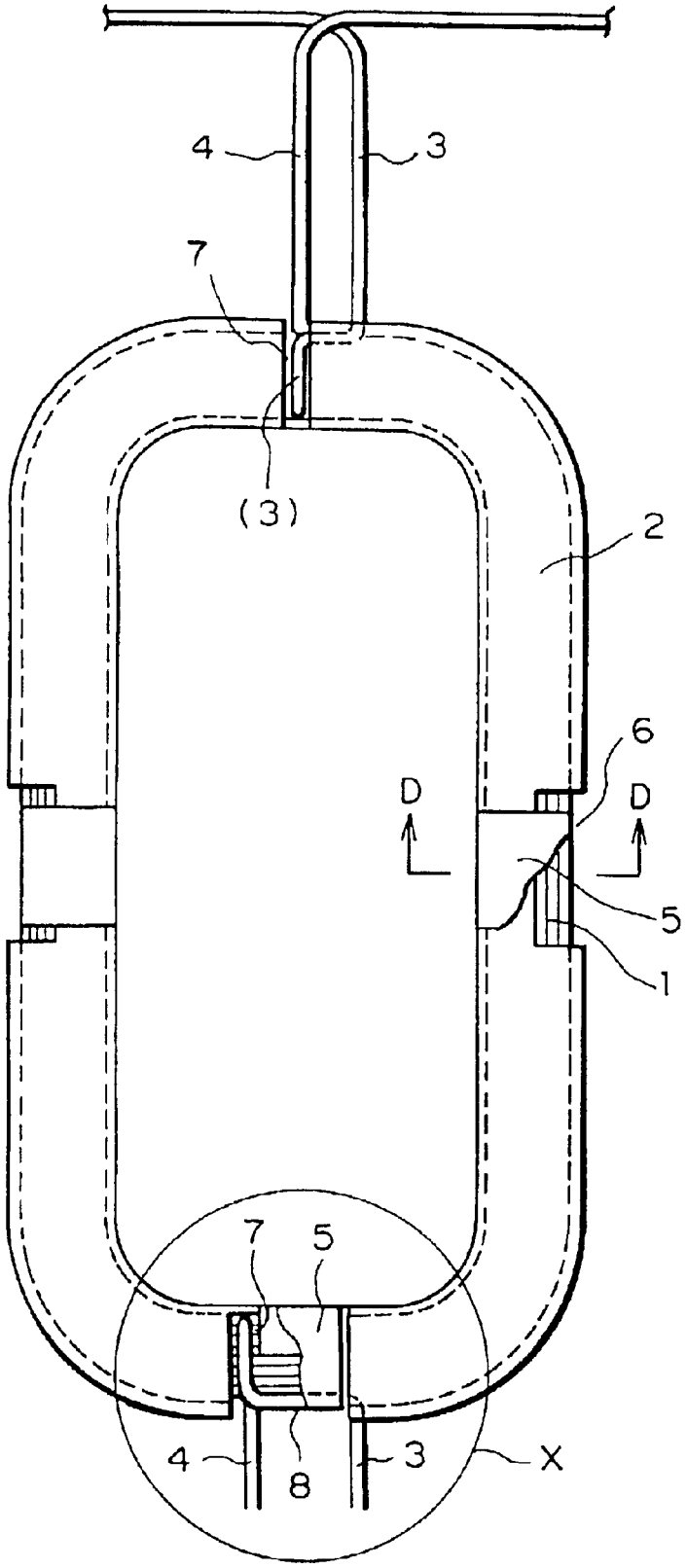
FIG. 1 is an explanatory drawing showing a winding structure according to an example of the present invention.
Figure 2:
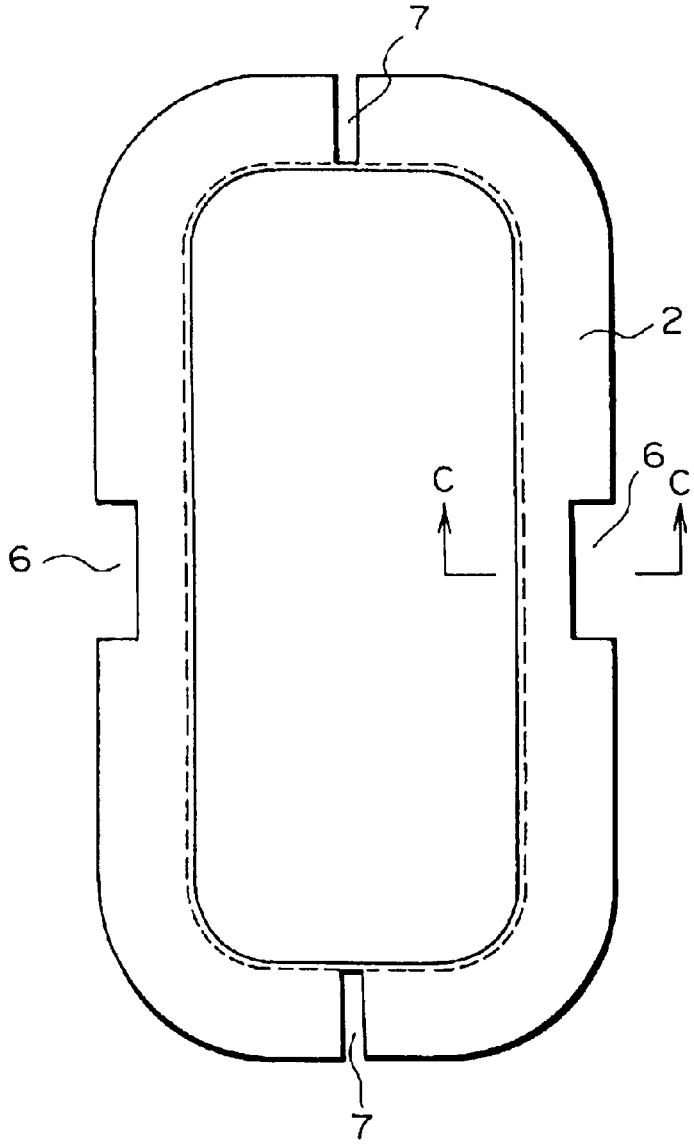
FIG. 2 is an explanatory drawing showing a shape of a bobbin used in FIG. 1 of an example.
Figure 3:
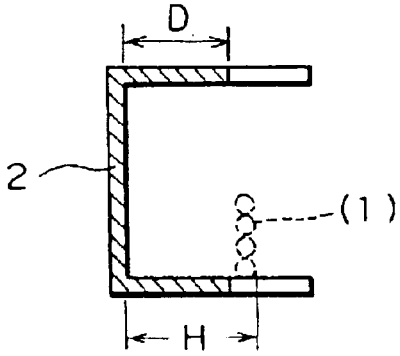
FIG. 3 is an enlarged view taken along a line C—C of FIG. 2.
Figure 4:
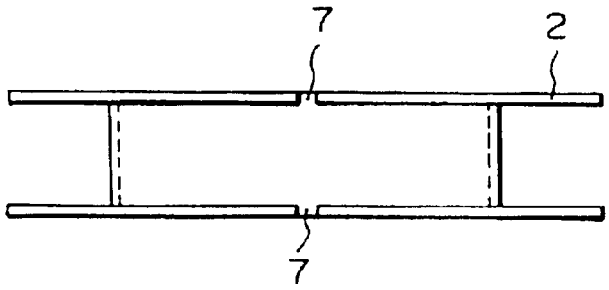
FIG. 4 is a top view of FIG. 2.

FIG. 1 is an explanatory drawing showing a configuration of a winding structure according to an example of the present invention. FIG. 2 is an explanatory drawing showing a shape of a bobbin used in FIG. 1 according to an example. FIG. 3 is an enlarged view taken along a line C—C of FIG. 2. FIG. 4 is a top view of FIG. 2.

In FIGS. 1, 2, 3, and 4, rectangular notches 6 are formed on both sides along a length of the bobbin 2 which is shaped like U in a cross section. Further, except for along a length of the bobbin 2, notches 8 are formed to allow a wire on a lead-out part of a shunt coil winding start 3 to escape from the inside of the bottom of a winding frame of the bobbin, which is shaped like U in a cross section, to the outside. The notch 8 is composed of a notch 7, which is in the form of thin slit and straight in shape, or is formed by integrating the notch 6 and the notch 7 where the lead-out part of the shunt coil winding start 3 is drawn to the outside (see circle X).

Figure 5:
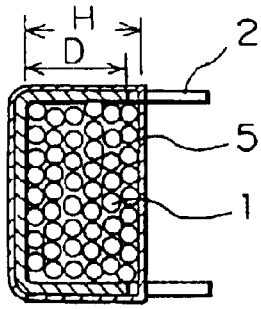
FIG. 5 is a drawing taken along a line D—D of FIG. 1.

And then, as shown in FIG. 5, the notches 6 on both sides along the length of the bobbin 2 are formed with a depth larger than a winding height of a shunt coil 1. Namely, a side winding frame D of the notch 6 is lower (shorter) than a winding height H of the shunt coil 1. Hence, the shunt coil 1 wound around the bobbin 2 is directly fixed into the bobbin 2 by taping the winding frame of the bobbin 2 with an insulating tape 5 from the outside, thereby preventing the shunt coil 1 from vibrating.

Moreover, as shown in FIG. 4, which is a top view of FIG. 2, the straight notches 7 in the form of thin slits on the top of the bobbin 2 are provided on the winding frame on both sides of the bobbin 2. However, the notches 7 may be formed on the winding frame of the bobbin 2 on one of the sides.

Figure 6:
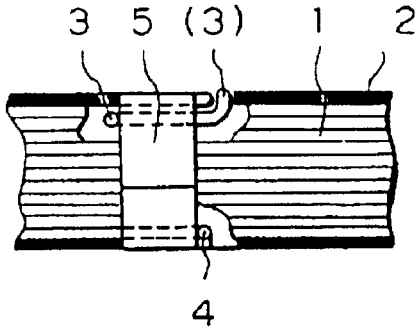
FIG. 6 is a partial top view of FIG. 1.

When the shunt coil 1 is automatically wound around the bobbin 2, the lead-out part of the shunt coil winding start 3 is drawn to the outside from the inside of the winding frame bottom of the notch 7 via the notch 7, and normal winding is performed in this state. Upon completion of winding by a prescribed number of turns, the shunt coil winding start 3 is bent as shown in FIG. 1 and is taken out in the direction of a shunt coil winding end 4 along the notch 7. And then, as shown in FIG. 6, the shunt coil winding start 3 and the shunt coil winding end 4 are adhesively fixed together with the bobbin 2 by an insulating tape 5.

At this point, since the wire on the lead-out part of the shunt coil winding start 3 is drawn to the outside of the winding frame of the bobbin 2, the wire does not interfere with the normal winding of the automatic winding and the top end of the side winding frame of the bobbin 2 is less likely to be widened. Further, the lead-out part of the shunt coil winding start 3 is disposed along the notch 7. Namely, the thickness of the side winding frame of the bobbin 2 is used. Hence, the lead-out part of the shunt coil winding start 3 does not protrude from the surface of the side winding frame of the bobbin 2, or the protrusion is small.

Figure 7:
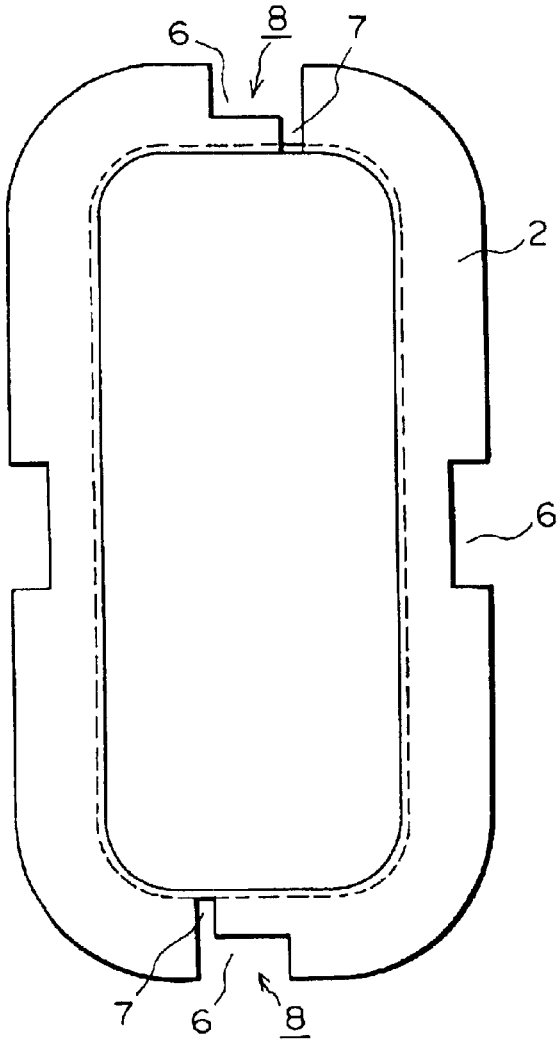
FIG. 7 is an explanatory drawing showing a bobbin used in FIG. 1 according to another example.
Figure 8:
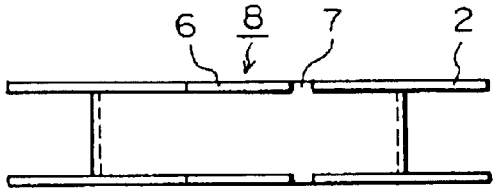
FIG. 8 is a top view of FIG. 7.

In a circle X on the lower part of the bobbin 2 of FIG. 1, as shown in FIGS. 7 and 8, a notch 8 is formed by integrating the notch 6, which is used for fixing the shunt coil 1, and the notch 7, which draws the lead-out part of the shunt coil winding start 3 to the outside.

In the notch 8, the notch 7 is formed, in which a wire on the lead-out part of the shunt coil winding start 3 of the above-described explanation is drawn to the outside from the winding frame on the side of the bobbin 2. Thus, as described above, the notch 7 makes it possible to draw a wire on the lead-out part of the shunt coil winding start 3 to the outside, thereby performing automatic normal winding on the shunt coil 1.

Figure 9:
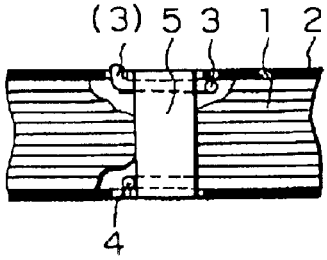
FIG. 9 is a partial bottom view of FIG. 1.

Upon completion of winding by the prescribed number of turns, the lead-out part of the shunt coil winding start 3 is bent as shown in FIG. 1 and is drawn in the direction of the shunt coil winding end 4 along the notch 7. And then, the shunt coil winding start 3 and the shunt coil winding end 4 are arranged as shown in FIG. 9, and the winding frame of the bobbin 2 is taped with the insulating tape 5 from the outside so as to firmly fix the shunt coil 1, which is wound around the bobbin 2, into the bobbin 2. In such a configuration, the shunt coil 1 does not vibrate.

Figure 10:
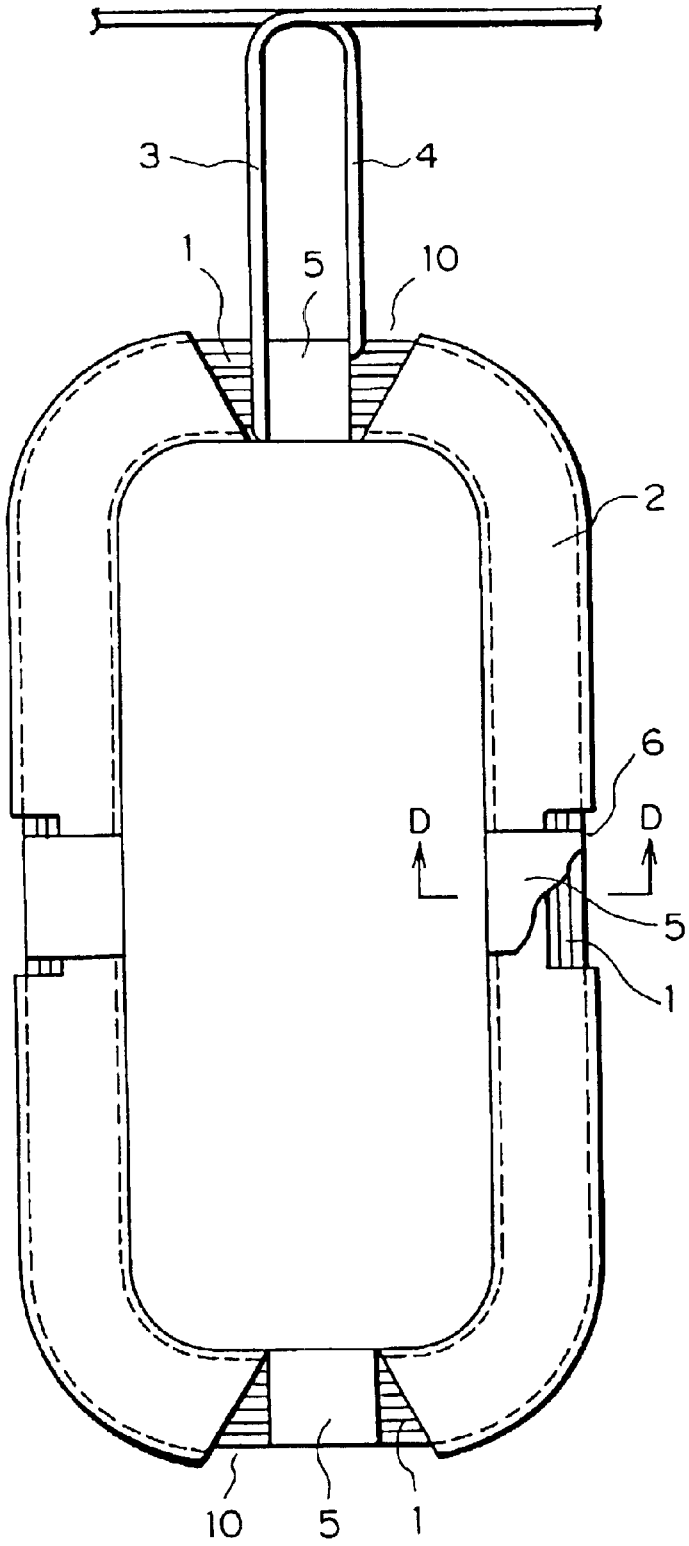
FIG. 10 is an explanatory drawing showing a winding structure according to another example of the present invention.
Figure 11:
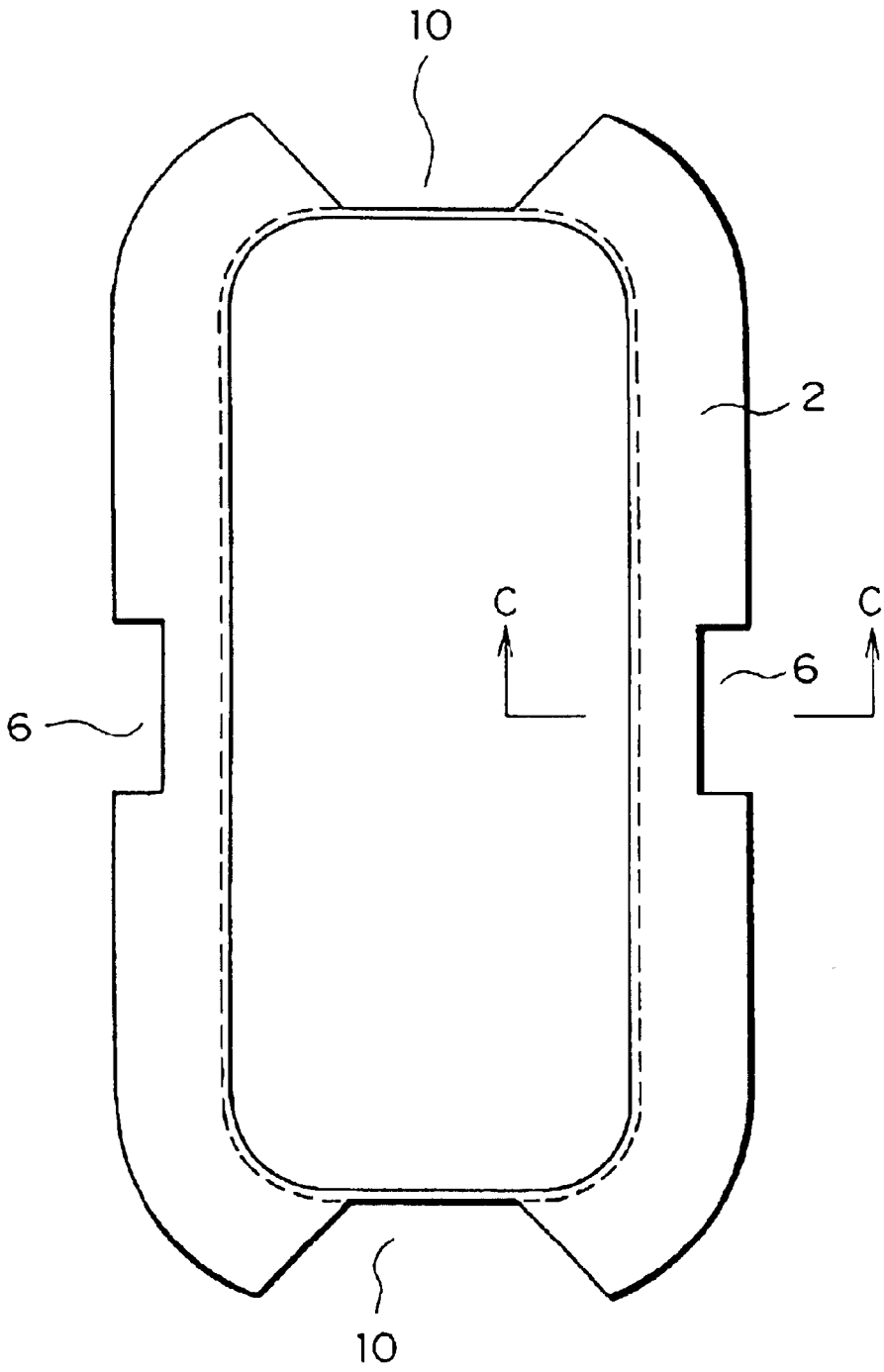
FIG. 11 is an explanatory drawing showing a shape of a bobbin used in FIG. 10 according to an example.
Figure 12:
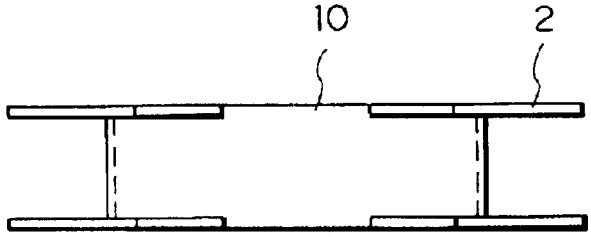
FIG. 12 is a top view of FIG. 11.

FIG. 10 is an explanatory drawing showing the winding structure according to another example of the present invention. FIG. 11 is an explanatory drawing showing the shape of a bobbin used in FIG. 10 according to an example. FIG. 12 is a top view of FIG. 11.

In FIGS. 10, 11, and 12, rectangular notches 6 are formed on both sides along the length of the bobbin 2 which is shaped like U in a cross section. Further, except for along the length of the bobbin 2, tapered notches 10 are formed which draw a wire on a lead-out part of the shunt coil winding start 3 to the outside from the inside of the bottom of the winding frame.

Although it is desirable to form the tapered notches 10 at two places, the tapered notch 10 may be formed at one place.

Moreover, as shown in the above-described FIG. 5, the notches 6 on both sides along the length of the bobbin 2 have a depth larger than a winding height of the wound shunt coil 1. Namely, a side winding frame D of the notch 6 is lower (shorter) than a winding height H of the shunt coil 1. Hence, the winding frame of the bobbin 2 is taped with the insulating tape 5 from the outside, so that the shunt coil 1 wound around the bobbin 2 is directly fixed into the bobbin 2 and the shunt coil 1 does not vibrate in the bobbin 2.

Further, as shown in FIG. 12, which is a top view of FIG. 11, the notches 10 formed in a direction other than along the length of the bobbin 2 are respectively provided on both of the side winding frames of the bobbin 2. However, the notches 10 may be formed on one of the side winding frames of the bobbin 2.

Figure 13:
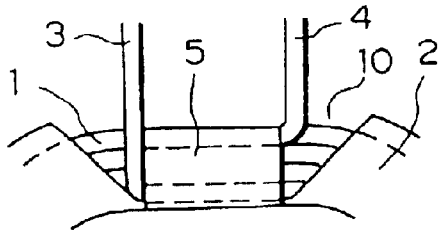
FIG. 13 is an enlarged explanatory drawing showing a configuration of a notch provided on the top of a bobbin shown in FIG. 10.
Figure 14:
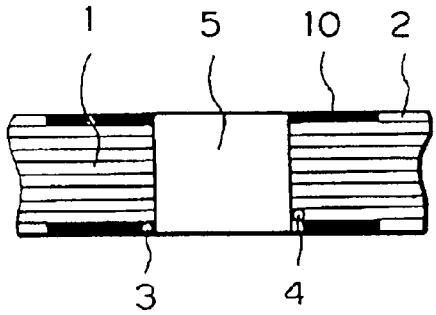
FIG. 14 is a top view of FIG. 13.

When the shunt coil 1 is automatically wound around the bobbin 2, the lead-out part of the shunt coil winding start 3 is drawn to the outside from the inside of the winding frame bottom of the notch 10, and normal winding is performed in this state. Upon completion of winding by the prescribed number of turns, the shunt coil winding start 3 is bent as shown in FIG. 10 and so on and is drawn in the direction of a shunt coil winding end 4 along an end face of a laminated shunt coil of the notch 10. And then, as shown in FIGS. 10, 13, and 14, the shunt coil winding start 3 and the shunt coil winding end 4 are adhesively fixed by an insulating tape 5.

At this point, since the wire on the lead-out part of the shunt coil winding start 3 is drawn to the outside of the winding frame of the bobbin 2 by the notch 10, the wire does not interfere with the normal winding of the automatic winding, and the top end of the side winding frame of the bobbin 2 is less likely to be widened.

Figure 15:
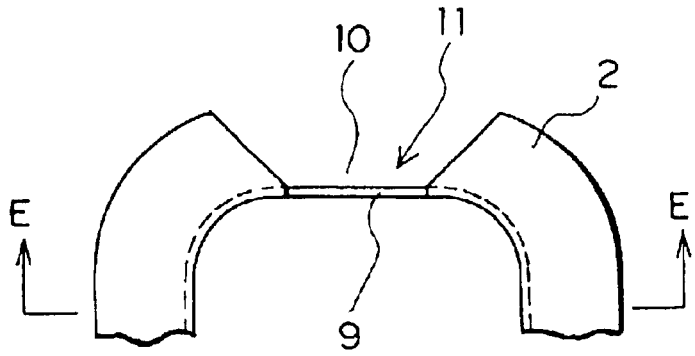
FIG. 15 is a partial explanatory view showing a notch for processing a winding start of a shunt coil according to another example.
Figure 16:
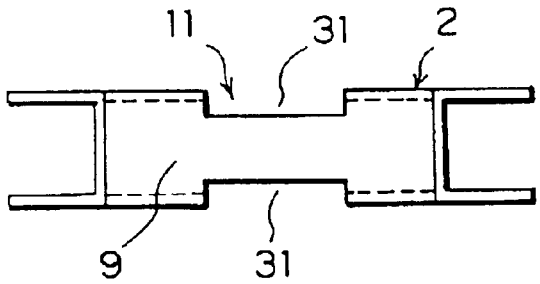
FIG. 16 is a drawing taken along a line E—E of FIG. 15.

FIG. 15 is an explanatory drawing showing a part of a notch for processing the winding start of a shunt coil according to another example. FIG. 16 is a drawing taken along ling E—E of FIG. 15.

In FIGS. 15 and 16, a notch 11 is formed by the tapered notch 10, which was discussed in FIG. 11 and so on, and notches 31 provided continuously with the notch 10 on a winding frame bottom 9 of a bobbin. In the notch 11, processing is made on a lead-out part of a shunt coil winding start 3 at a position where winding of a shunt coil 1 is started and a wound shunt coil 1 is fixed into the bobbin 2.

In a bobbin 2 where the notch 11 is formed, since the notch 31 is additionally formed, the shunt coil 1 wound around the bobbin 2 can be fixed more strongly together with the shunt coil winding start 3 and a shunt coil winding end 4 by the winding of an insulating tape 5 using the notch 31.

Needless to say, when the notch 11 formed on the bobbin 2 is provided on one of the side winding frames, the notch 31 is formed only on one of the sides.

Further, on the winding frame bottom of the bobbin 2 shown in FIGS. 2 and 7, the notch 31 of FIG. 16 may be formed continuously with the notches 6 and 8.

Figure 17:
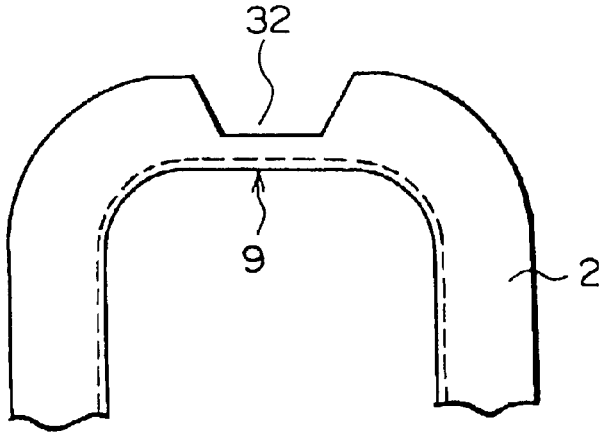
FIG. 17 is a partial explanatory drawing showing a notch for processing the winding start of a shunt coil according to another example.

FIG. 17 is an explanatory view showing a notch for processing the winding start of a shunt coil according to another example.

Figure 24:
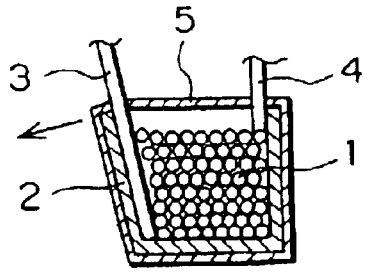
FIG. 24 is a sectional view taken along a line B—B of FIG. 22.

In FIG. 17, a tapered notch 32 has a notched part not reaching a winding frame bottom 9 of a bobbin 2. As evident from FIG. 24, in this configuration, a wire on a lead-out part of a shunt coil winding start 3 has little influence on a winding frame near the winding frame bottom 9 of the bobbin 2. A wire on a lead-out part of the shut coil winding start 3 is drawn to the outside of the winding frame from a midpoint of the formed notch 32 to prevent the top end of the winding frame of the bobbin 2 from being widened.

In the shape of the bobbin 2, regarding a notch for preventing the lead-out part on the shunt coil winding start 3 from protruding outward from the inside of the side winding frame of the bobbin 2, a symmetrical shape of the bobbin 2 is generally adopted in practical use in order to secure working property and general versability of the bobbin 2.

Figure 18:
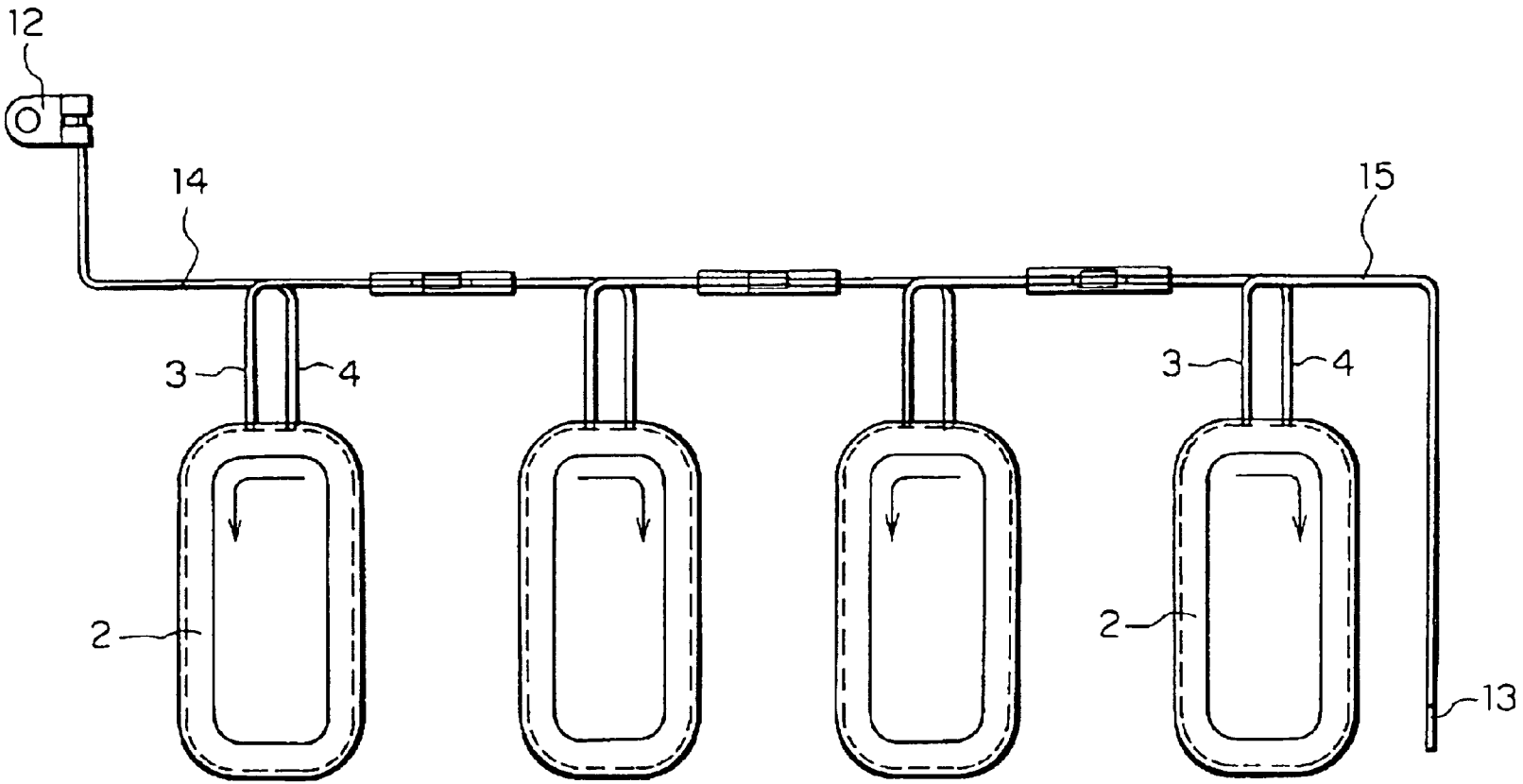
FIG. 18 is an assembly drawing showing shunt coils of a 4 poles starter motor.

FIG. 18 is an assembly drawing showing shunt coils of a 4 poles starter motor, and the detailed illustration including the above-described notches is omitted. The shunt coil winding start 3 and the shunt coil winding end 4 are connected to each other and are suitably connected to conductors 14 and 15 having terminals 12 and 13 such that current is applied in the directions of arrows to the shunt coils 1 wound around the bobbins 2.

Figure 19:
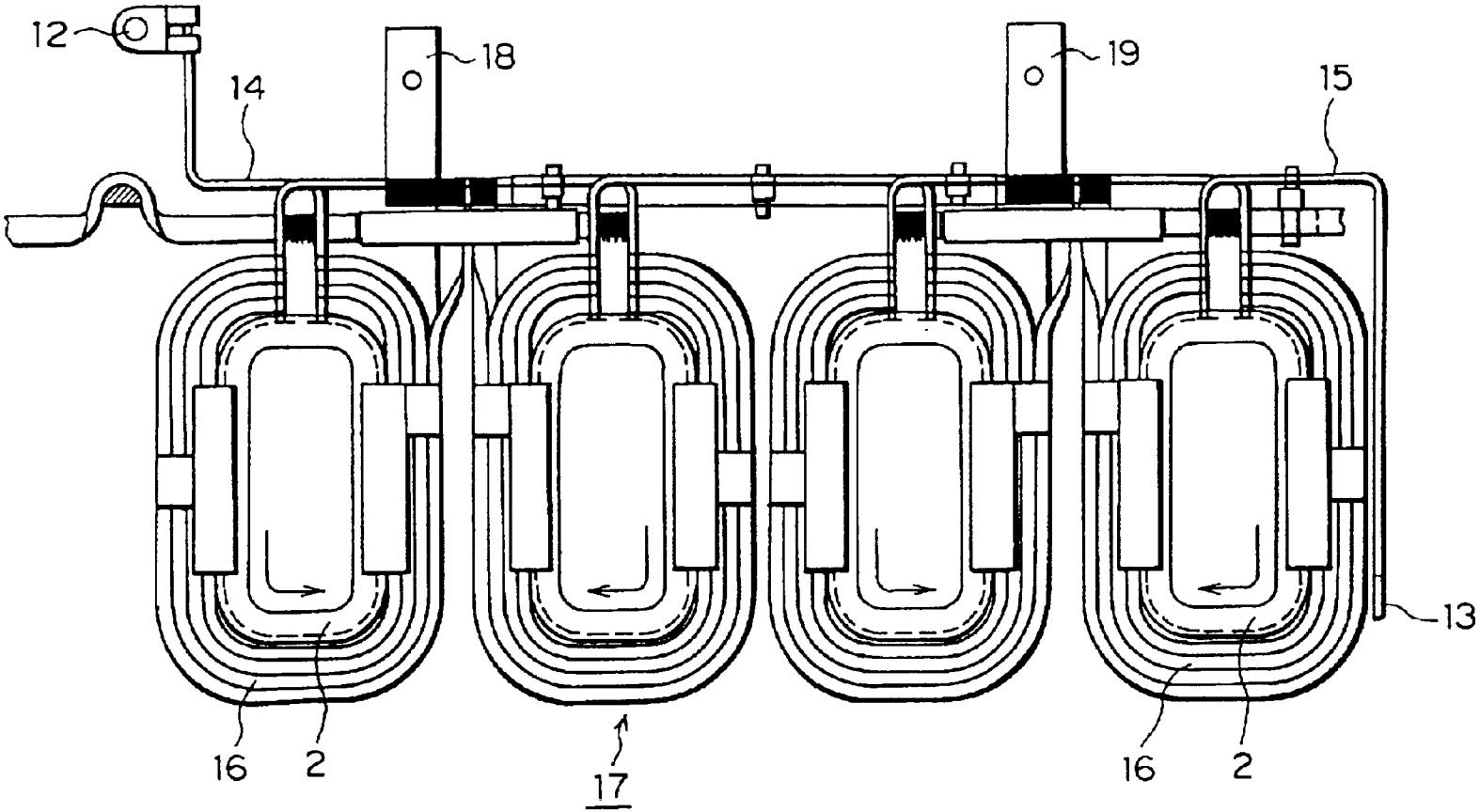
FIG. 19 is an explanatory drawing showing a field winding assembly body of a field winding according to an example.

The shunt coils assembled as shown in FIG. 18 are mounted in field coils 16 having flat copper wires as shown in FIG. 19. The field coils 16 are electrically and mechanically connected to one another to form a field winding assembly body 17. Besides, reference numerals 18 and 19 denote terminals of the field coil 16.

Figure 20:
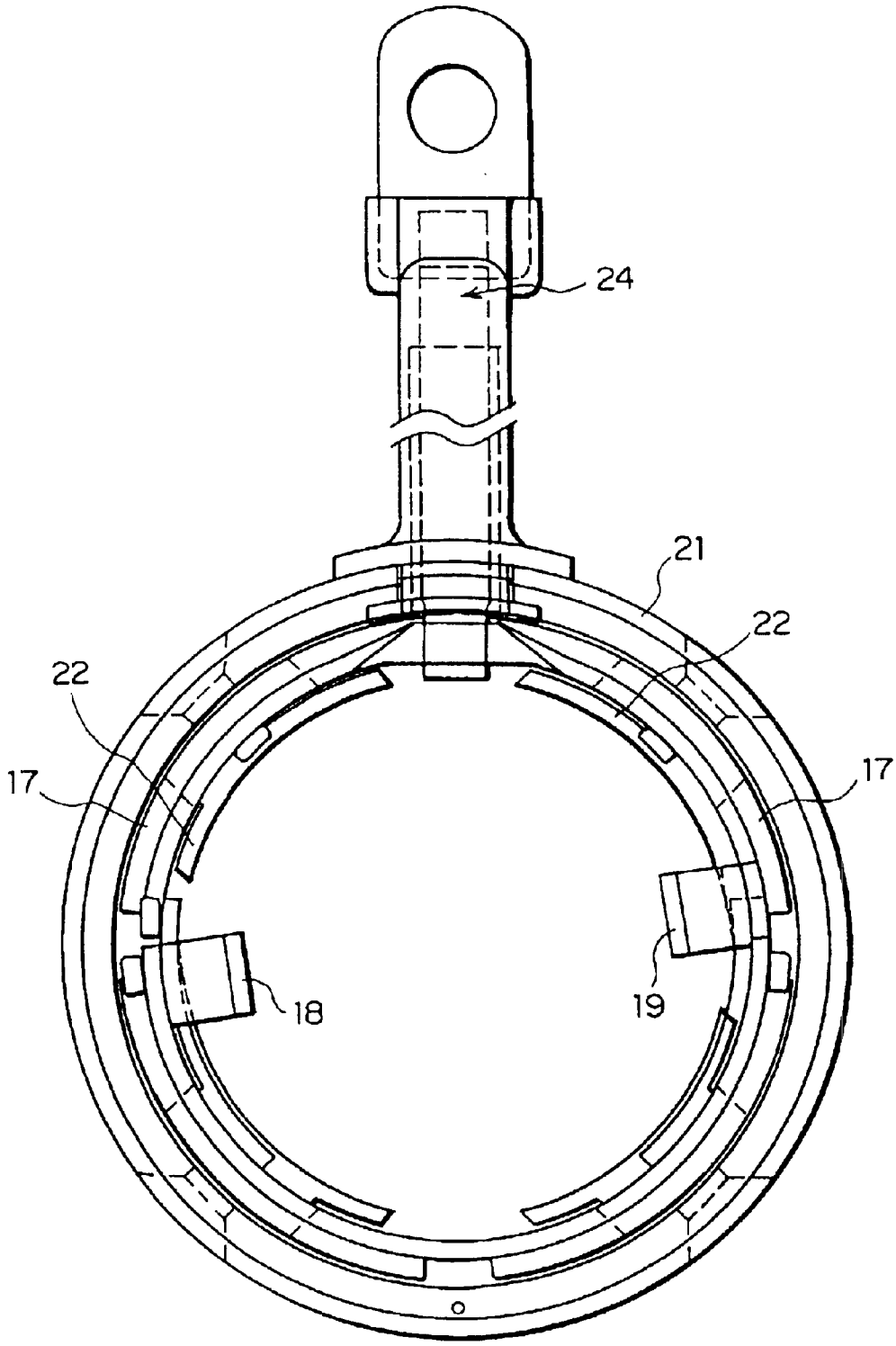
FIG. 20 is a front view showing a field winding assembly body incorporated in a yoke of a starter according to the example.
Figure 21:
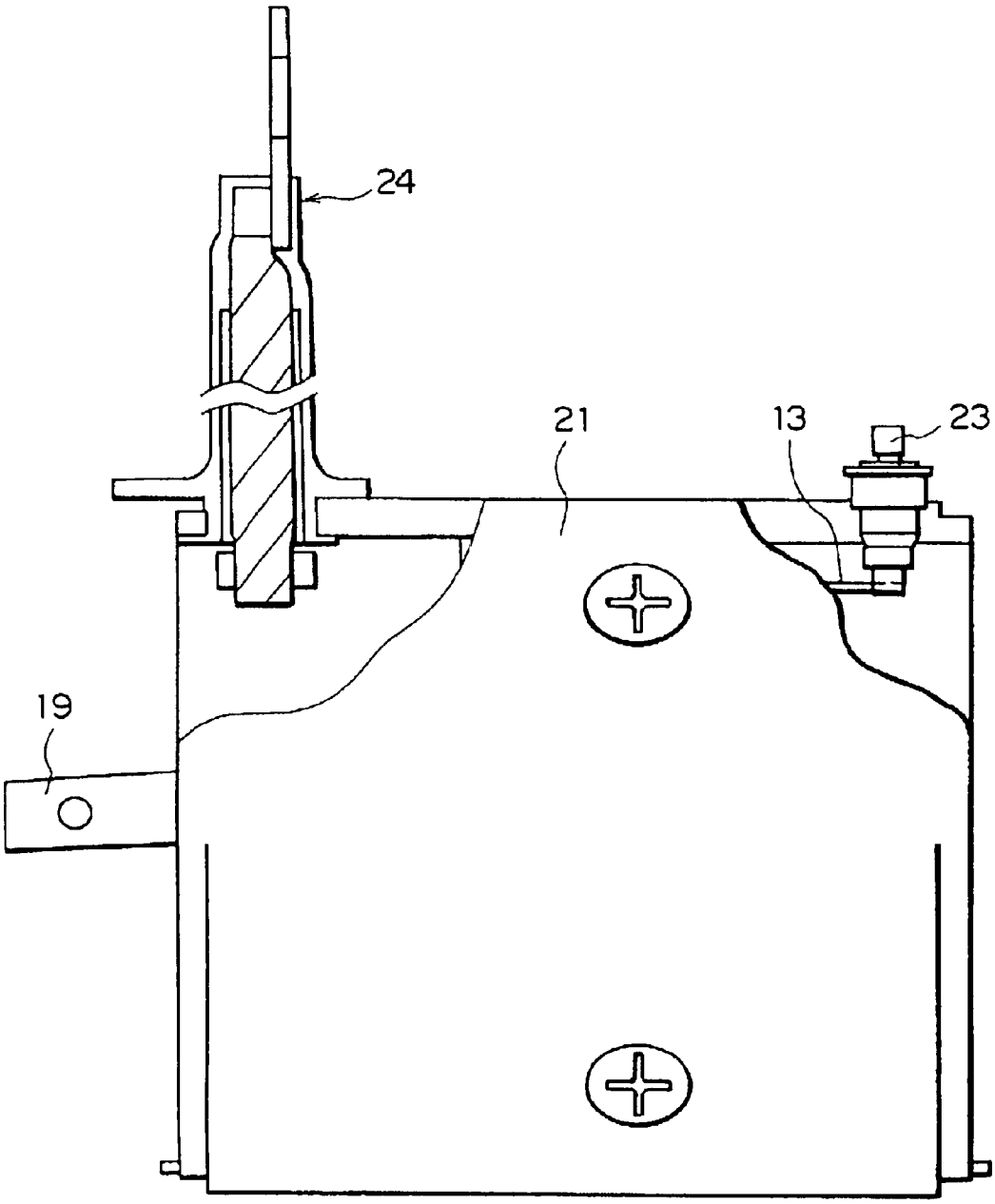
FIG. 21 is a side view partially including a sectional view.
Figure 22:
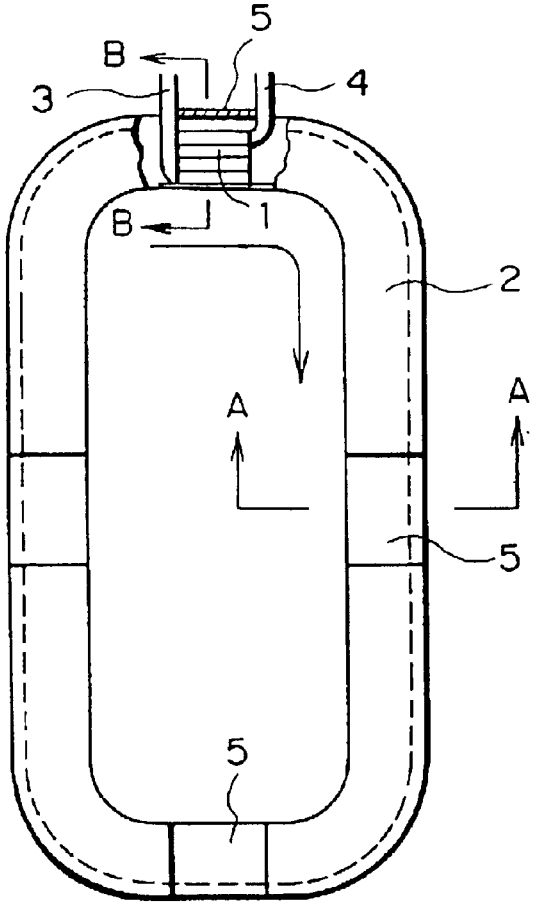
FIG. 22 is an assembly drawing showing a conventional shunt coil winding.
Figure 23:
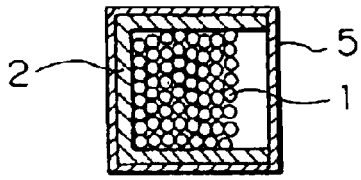
FIG. 23 is a sectional view taken along a line A—A of FIG. 22.

FIG. 20 is a front view showing a field winding assembly body incorporated into a yoke of a starter according to an example. FIG. 21 is a side view of FIG. 20 that partially includes a sectional view.

In FIGS. 20 and 21, the field winding assembly body 17 of FIG. 20 is formed in the shapes of a yoke 21 and a pole core 22 placed into the yoke 21, and the assembly body 17 is placed into the yoke 21 together with the pole core 22.

A terminal bolt 23 is provided on an end of the yoke 21, an end 13 of the conductor 15, which is a lead wire of the shunt coils constituting the field winding assembly body 17, is connected to the terminal bolt 23, and a cord assembly body 24 is provided on the other end of the yoke 21.

As described above, according to the present invention, since a rectangular notch which has a depth larger than a winding height of a shunt coil is provided on a winding frame on at least one of the side winding frames of a bobbin to be taped, the shunt coil can be directly fixed into the bobbin.

The bobbin is configured such that a straight or tapered notch shaped like a slit is provided on at least one of the side winding frames of the bobbin at the shunt coil winding start, or a notch is provided on the bottom of the winding frame of the bobbin continuously with the above-described notch. Thus, the top end of the side winding frame of the bobbin is less likely to be widened and normal winding can be performed by an automatic coil winder.

In addition, a lead-out part of the shunt coil winding start can be drawn along an end face of a laminated shunt coil of the notch provided on the side winding frame. Thus, it is possible to prevent a wire on a lead-out part of the shunt coil winding start from protruding from the side winding frame of the bobbin to the outside surface or to reduce the protrusion.

What is claimed is:

1. A winding structure of a starter, in which a shunt coil is wound around a bobbin shaped like U in a cross section, the shunt coil wound around the bobbin is taped and fixed as a plurality of places together with the bobbin, and the shunt coil as placed into a yoke of the starter in this state, wherein the bobbin has a first notch formed with a depth larger than a winding height of the shunt coil on both of side winding frames of the bobbin at a taping position.

2. The winding structure of the starter according to claim 1, wherein the bobbin has a straight second notch formed from a bottom of the winding frame on at least one of the side winding frames at a position of the bobbin where winding of the shunt coil is started.

3. A winding structure of a starter, in which a shunt coil is wound around a bobbin shaped like U in a cross section, the shunt coil wound around the bobbin is taped and fixed at a plurality of places together with the bobbin, and the shunt coil is placed into yoke of the starter in this state, wherein the bobbin has a tapered second notch which is formed from the bottom of a winding frame on at least one of side winding frames at a position of the bobbin where winding of the shunt coil is started.

4. A winding structure of a starter, in which a shunt coil is wound around a bobbin shaped like U in a cross section, the shunt coil wound around the bobbin is taped and fixed at a plurality of places together with the bobbin, and the shunt coil is placed into a yoke of the starter in this state, wherein the bobbin has a first notch which is formed with a depth larger than a winding height of the wound shunt coil on both of side winding frames of the bobbin it a taping position, and the bobbin has a tapered second notch formed on at least one of the side winding flames at a position of the bobbin where winding of the shunt coil is started.

5. The winding structure of a starter according to claim 4, wherein the first notch and/or the second notch is formed from the bottom of the winding frame.

6. The winding structure of a starter according to claim 4, wherein the first notch and/or the second notch is formed continuously with a third notch formed on the bottom of the winding frame of the bobbin.

* * * * *